US010588813B2

(12) United States Patent
Grifhorst

(10) Patent No.: US 10,588,813 B2
(45) Date of Patent: Mar. 17, 2020

(54) ASSIST APPARATUS AND SYSTEM

(71) Applicant: Bruce A. Grifhorst, Grand Rapids, MI (US)

(72) Inventor: Bruce A. Grifhorst, Grand Rapids, MI (US)

( * ) Notice: Subject to any disclaimer, the term of this patent is extended or adjusted under 35 U.S.C. 154(b) by 0 days.

(21) Appl. No.: 15/577,975

(22) PCT Filed: May 31, 2016

(86) PCT No.: PCT/US2016/035054
§ 371 (c)(1),
(2) Date: Nov. 29, 2017

(87) PCT Pub. No.: WO2016/196487
PCT Pub. Date: Dec. 8, 2016

(65) Prior Publication Data

US 2018/0289580 A1 Oct. 11, 2018

Related U.S. Application Data

(60) Provisional application No. 62/169,193, filed on Jun. 1, 2015.

(51) Int. Cl.

| | |
|---|---|
| ***A61H 3/04*** | (2006.01) |
| ***A61H 99/00*** | (2006.01) |
| ***A45B 9/04*** | (2006.01) |
| ***A45B 3/00*** | (2006.01) |
| *A61H 3/02* | (2006.01) |

(52) U.S. Cl.
CPC ..... *A61H 3/04* (2013.01); *A45B 3/00* (2013.01); *A45B 9/04* (2013.01); *A61H 3/02* (2013.01); *A61H 99/00* (2013.01); *A61H 2201/0107* (2013.01); *A61H 2201/0119* (2013.01); *A61H 2201/0173* (2013.01)

(58) Field of Classification Search
CPC .. A61H 3/04; A61H 99/00; A45B 3/00; A45B 9/04; E05B 7/00
See application file for complete search history.

(56) References Cited

U.S. PATENT DOCUMENTS

| | | | | |
|---|---|---|---|---|
| 2,945,242 | A | 1/1958 | Heiden | |
| 4,922,560 | A * | 5/1990 | Skibinski | A61G 7/1038 135/67 |
| 5,295,498 | A | 3/1994 | Van Meter et al. | |
| 6,321,411 | B1 * | 11/2001 | Ikejiri | E05C 17/56 16/82 |
| 9,186,289 | B2 * | 11/2015 | Nicholas | B62H 1/06 |
| 2007/0079638 | A1 | 4/2007 | Leung | |
| 2015/0129735 | A1 | 5/2015 | Bard et al. | |
| 2018/0214337 | A1 * | 8/2018 | Hubert | A61H 3/04 |
| 2019/0142664 | A1 * | 5/2019 | Bard | A61G 5/14 248/346.04 |

* cited by examiner

*Primary Examiner* — Noah Chandler Hawk
(74) *Attorney, Agent, or Firm* — Frank M. Scutch, III

(57) ABSTRACT

A system for assisting a person to rise from or recline to a sitting position is disclosed employing a walker or cane having a connector that enables attachment and detachment with an anchor attached to the floor.

6 Claims, 10 Drawing Sheets

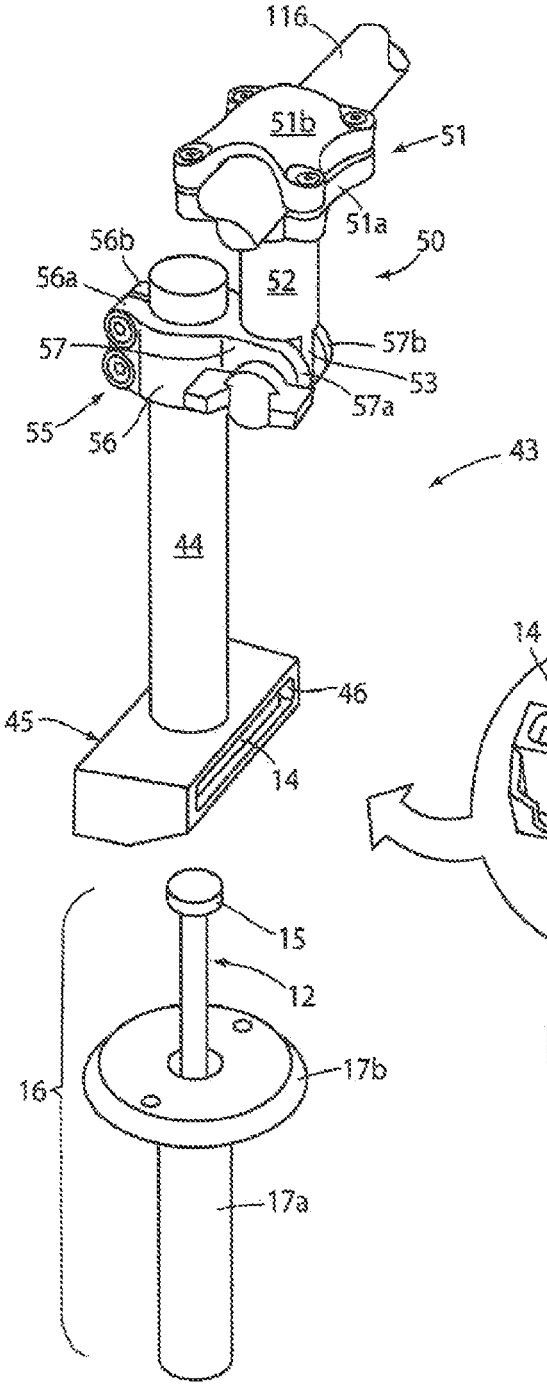
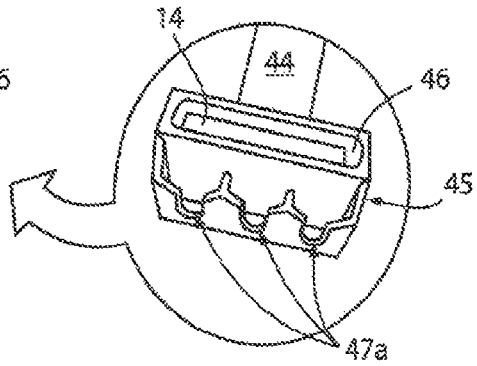
FIG. 14A
FIG. 14

ASSIST APPARATUS AND SYSTEM

CLAIM OF PRIORITY

Priority is claimed to international PCT application Serial No. PCT/US2016/035054, filed May 31, 2016, and to U.S. Provisional application Ser. No. 62/169,193, filed Jun. 1, 2015, which serves as the priority document for said PCT application.

FIELD OF THE INVENTION

The invention relates to assisting infirm people to rise from and recline to a sitting position without help of another person.

BACKGROUND OF THE INVENTION

It is common in a private or nursing home environment for residents to use conventional stand-alone walker or canes. These residents may temporarily require the assistance of a second person to sit or stand even when using the walker or cane. Such assistance is not always available and the infirm person must wait or attempt to do it themselves with possible falls or other consequences.

SUMMARY OF THE INVENTION

The present invention is a system for assisting a person to rise from or recline to a sitting position using a mobility assist device, such as for example a walking walker, standing cane, other cane or the like. The mobile assistance device is provided with a connector that is detachably engageable with a substrate mounted anchor device. When the connector is engaged with the anchor device, the mobile assistance device provides support for a person to pull on in the opposite direction to help the person sit or stand without the mobile assistance device becoming unstable.

These and other features, objects and advantages of the invention will be more fully understood and appreciated by reference to the description of the preferred embodiments, and the appended drawings.

BRIEF DESCRIPTION OF THE DRAWINGS

FIG. 14 is a perspective view of a connector for attachment to a mobility assist device, positioned above an anchor device, with the anchor withdrawn from its housing by the approaching magnet of the connector;

FIG. 14A is an enlarged lower, front perspective view of the anchor engaging housing of the connector of FIG. 14.

DETAILED DESCRIPTION OF THE PREFERRED EMBODIMENTS

Figure 1:
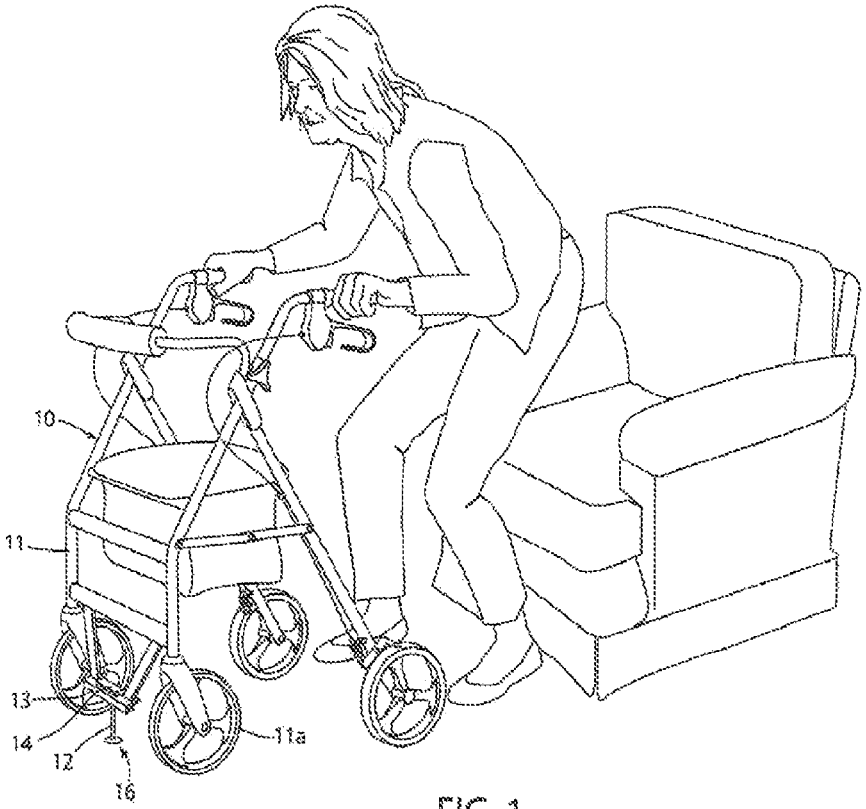
FIG. 1 is an illustration of a modified conventional walker engaged with an anchoring device.

In the following description of the preferred embodiments, the numbered parts in the Figures have the following meanings:

10—modified conventional walker
11—walker legs
11*a*—wheels attached to walker legs
11*b* lower cross piece of walker
13—connector
14—permanent magnet
16—anchor device
16*a* extendable anchor
12—slidable anchor restraining post
12*a*—stop
15—anchor head or enlarged upper portion of anchor restraining post
16*b*—an alternative embodiment extendable anchor
16*c*—biasing member for biasing extendable anchor 16*b* into its extended position
12*b*—latch engaging pins on the anchor restraining post 12 of an alternative embodiment anchor 16*b*
17—anchor housing
17*a*—alternative embodiment anchor housing
17*b*—anchor housing floor plate
17*c*—alternative anchor housing floor plate with notch openings 17*d*
18—collar of housing
19—spurs on outer surface of housing
20—slots
21—floor of a building
22—floor covering
23—quad cane
24—legs of quad cane
25—switchable permanent magnet connector
26—ferro magnetic horseshoe
27—rotatable permanent magnet
28—spring loaded support
29—spring
30—support bracket
31—switch
32—switch activator cable
33—steel plate anchor
34—handle
43—alternative embodiment connector
44 leg
45 anchor engaging receiver
46 magnet housing
47 slotted cavities
50—coupler
51 clamping member
51*a* clamping half
51*b* clamping half
52 central body
53 tab

Figure 2:
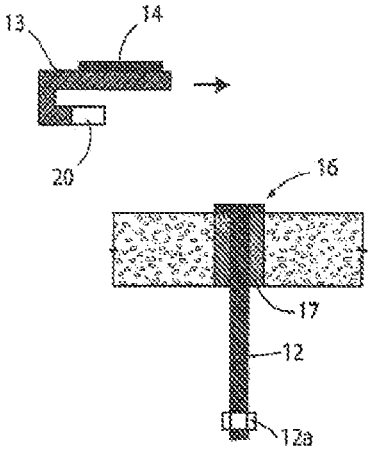
FIGS. 2-4 show the sequence of the slidable restraining post of an anchor device engaging with the connector where the restraining post slides from a retracted position to an extended position.
Figure 3:
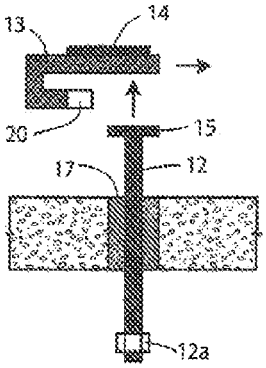
Figure 4:
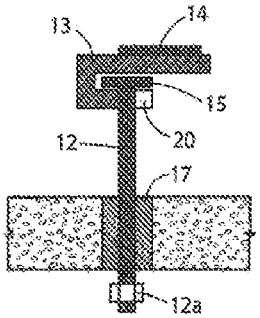
Figure 5:
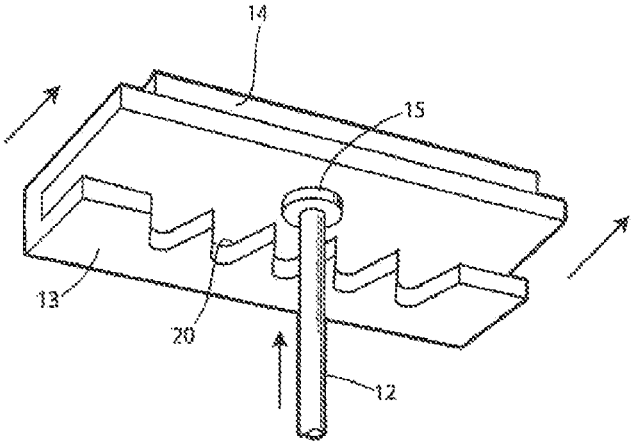
FIGS. 5-6 show another view of the slidable restraining post engaging in one of the slots of a connector.
Figure 6:
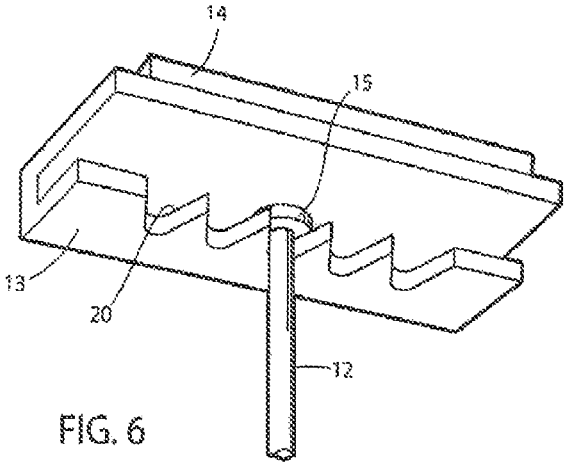
Figure 9:
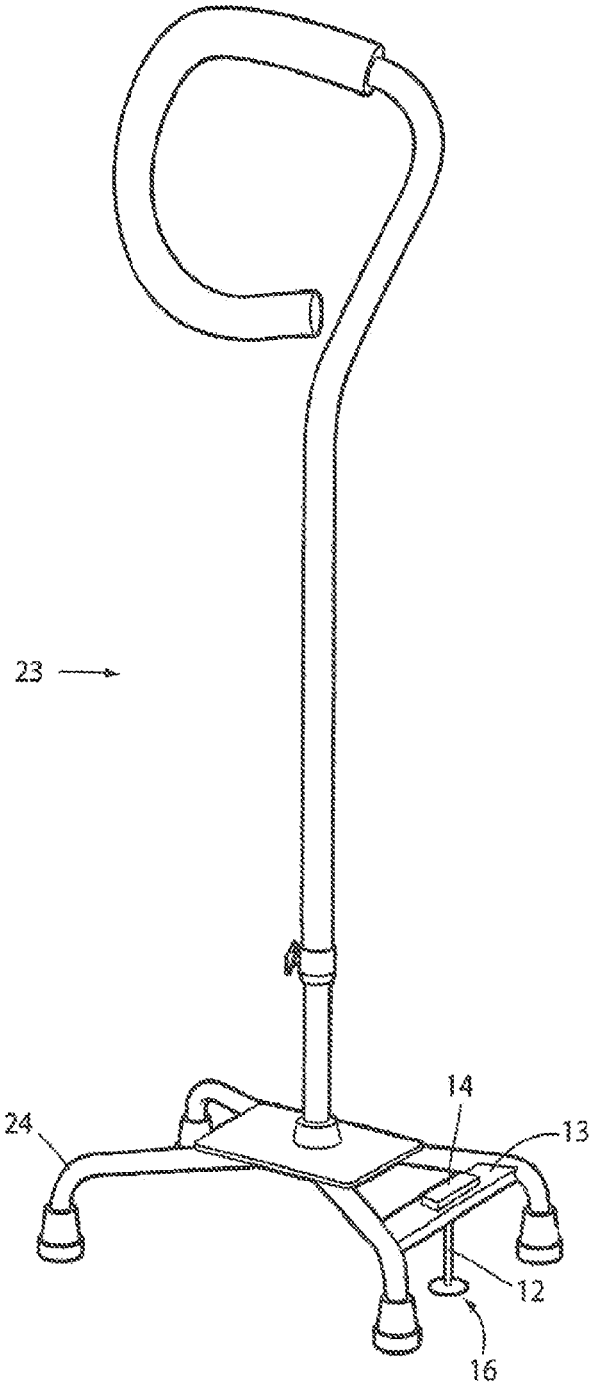
FIG. 9 shows a modified standing cane engaged with an anchoring device.
Figure 10:
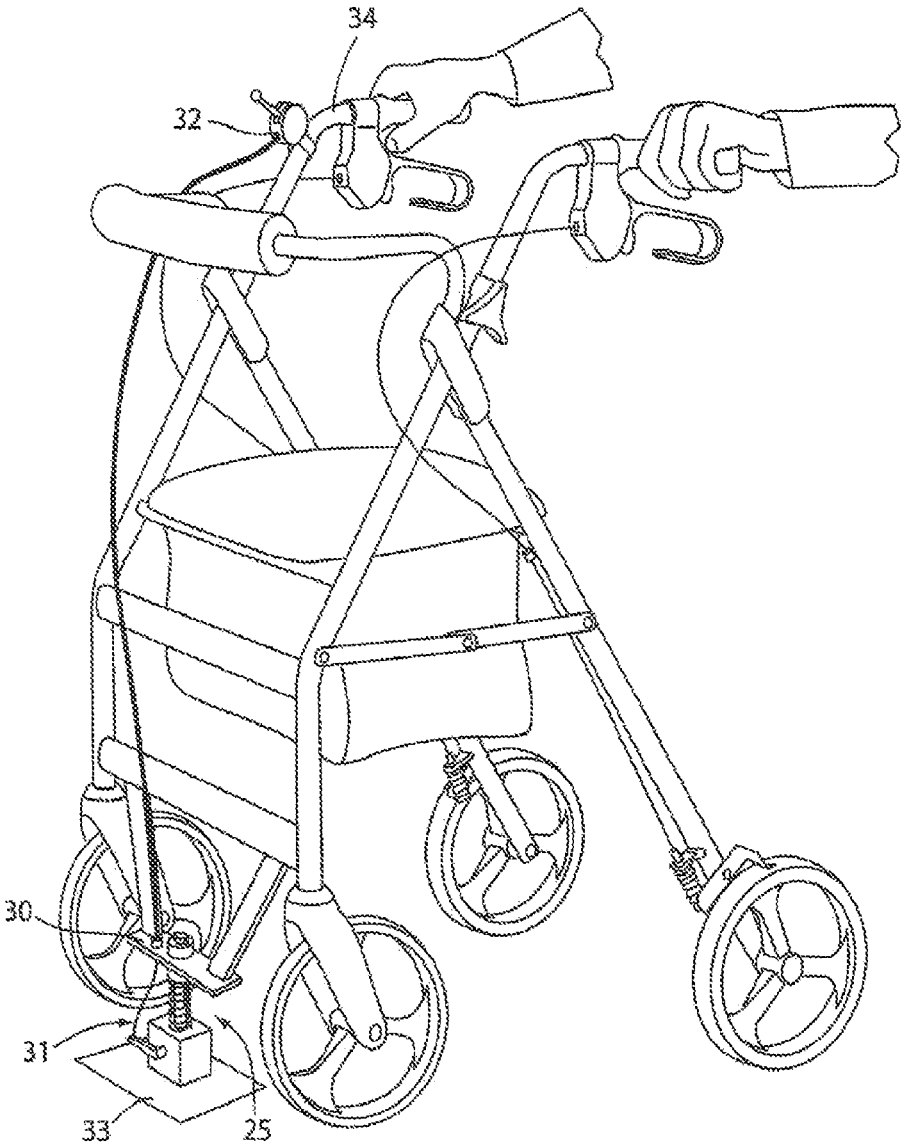
FIG. 10 shows an embodiment using a switchable permanent magnet connector on a walker engaged with an anchor device.
Figure 11:
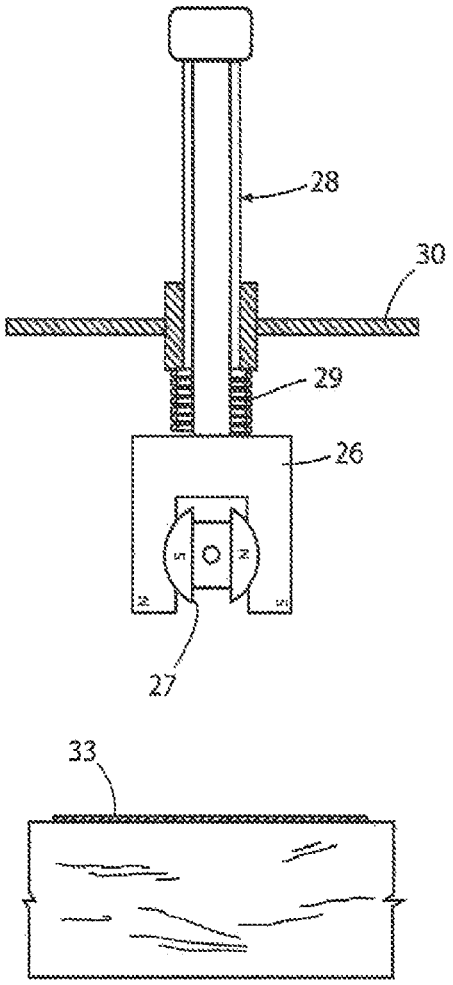
FIGS. 11 and 12 show the connector of FIG. 10 in a retracted position and engaged with an anchor device.
Figure 12:
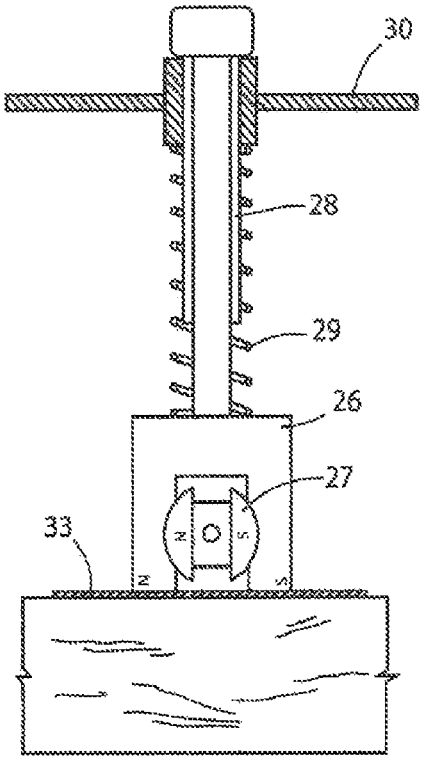
Figure 13:
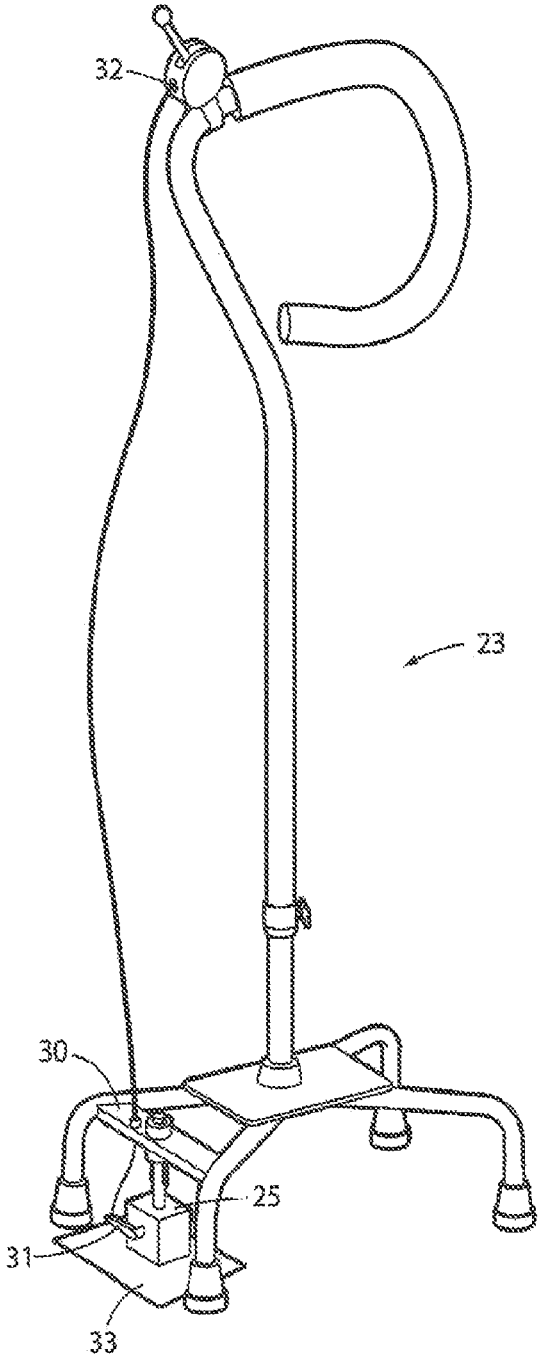
FIG. 13 shows the connector of FIG. 10 attached to a standing cane.

55 clamping member
56 split ring clamp
56*a* clamping arm
56*b* clamping arm
57 "U" shaped clamp
57*a* clamp arm
57*b* clamp arm
58 wing head bolt Referring to FIG. 1, there is shown a walker 10, modified by attaching a connector 13 to the bottom portion of the two front legs 11. The walker is shown with wheels 11*a* but other conventional walker designs can be used such as those having four legs but instead of wheels being provided with pliable end caps. The walker 10 is shown engaged with an anchor device 16 comprising an anchor 16*a* made of ferromagnetic material, and a housing 17 made preferably of non-ferromagnetic material. Anchor 16*a* includes a restraining post 12 and an enlarged upper portion 15 (FIGS. 2-4). The restraining post 12 is slideably received in housing 17 so it is free to slide up and down in the housing 17. It is prevented from completely becoming separated from the housing by having a stop 12*a* at the lower end. The connector 13 as shown in the embodiments of FIGS. 2-6 comprises a "J" shaped bar having slots 20 on the lower narrower portion for engaging the restraining post 12. When so engaged the walker (and the quad cane of FIG. 9) is prevented from tipping backwards when grasped by a person and used to pull him or herself to a standing position or reclining to a sitting position. The level of the slots 20 above the surface of the floor and the maximum height of the restraining post 12 are matched so that the slots will engage the post below the enlarged upper portion 15.

In the embodiments in FIGS. 1-14, the anchor 16*a*, including its restraining post 12, is pulled from the anchor housing 17 by a strong magnet 14 attached to the connector 13. To engage the post 12 with the slots the user moves the walker backwards over the anchor device 16, the magnet 14 raises the restraining post 12 and one of the slots 20 is engaged. This sequence of steps is illustrated in FIGS. 2-4. The walker can then be used by person to raise or lower himself from, or to, a sitting position because the connector-anchor engagement prevents the walker from tipping toward the person when pulling on it. Reversing the sequence of steps disengages the slot 20 from the restraining post 12 and the restraining post 12 slides back into the housing 17 of the anchor device 16. The quad cane 23 can be engaged and disengaged using the same sequence of steps.

Figure 7:
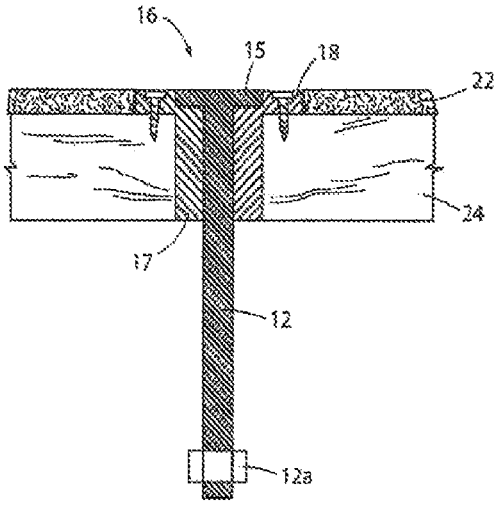
FIG. 7 shows one embodiment of an anchoring device set into a floor.
Figure 8:
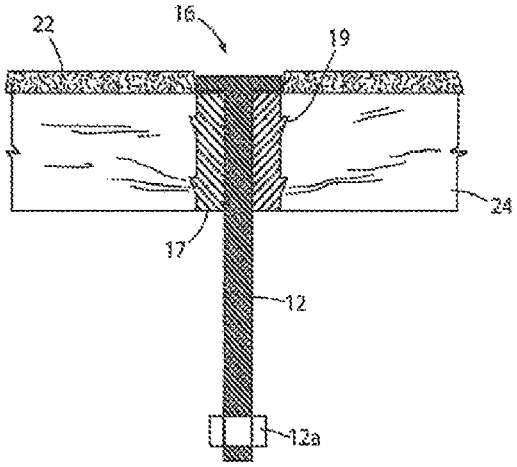
FIG. 8 shows a second embodiment of an anchoring device set into a floor.

It is preferred that the top of the anchor device 16 is flush with the surface of the floor 21 to prevent tripping. Two embodiments of securing an anchor device 16 to a floor are illustrated in FIGS. 7 and 8. In FIG. 7 the anchor device 16 comprises a housing 17 having a collar 18 that can be placed in a hole in the floor and secured through the collar 18 with screws or the like. In FIG. 8 the anchor device 16 comprises a housing 17 having spurs 19 projecting from the outer surface which engaged the sides of the hole formed in the floor and secure it there. In both embodiments the restraining post 12 is slidably secured in the housing so it can easily be raised and then slide back into the housing when not being used.

Figure 15:
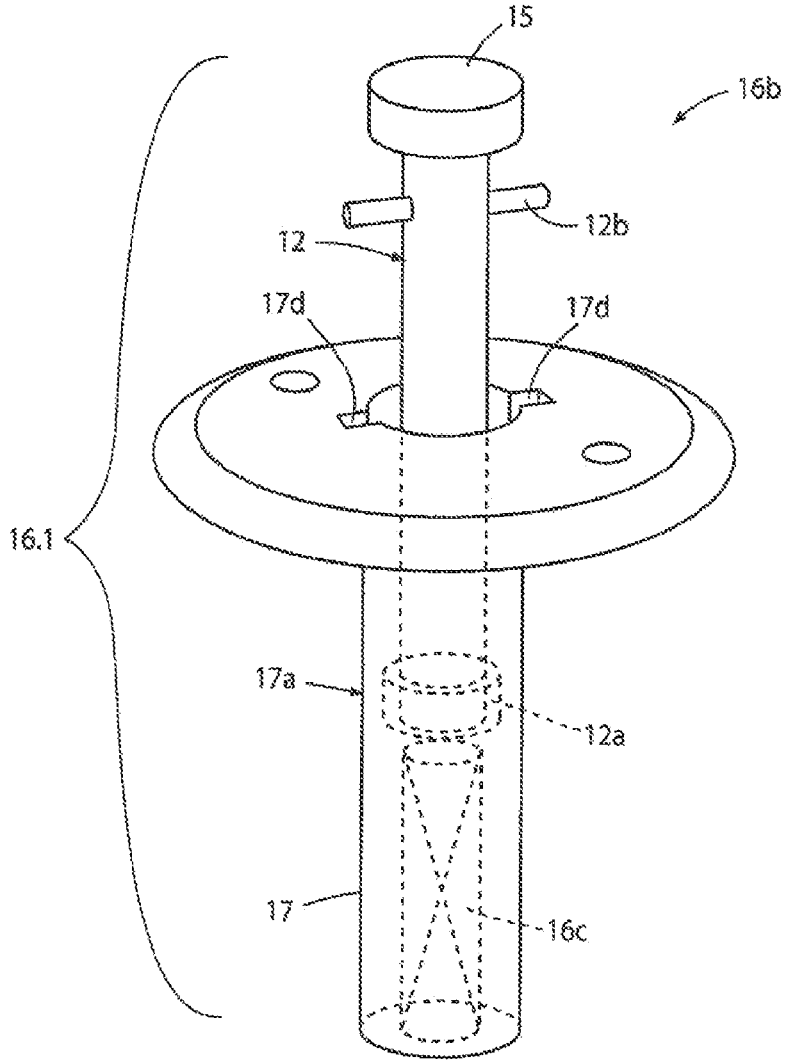
FIG. 15 is a perspective view of an alternative embodiment anchor device which does not require use of a magnet in the connector.

Instead of using a magnet on the connector to raise the anchor 16*a* of an anchor device 16, an alternative embodiment anchor device 16.1 can be used that employs a spring, magnetic or other biasing member 16*c* for biasing restraining post 12 partially out of housing 17 (FIG. 15). It can be retained in housing 17 by a catch, which is activated to release anchor 16*a* by pushing and/or twisting anchor 16*b*. For example, when a user steps on head 15 and pushes anchor 16*b* down against the biasing force of biasing member 16*c*, catch pins 12*b* pass through the notches 17*d* in floor plate 17*c*. The user then twists his or her foot slightly, to turn the catch pins 12*c* under floor plate 17*c*, thus holding anchor 16*b* down. By engaging anchor head 15 with the foot and twisting slightly the other way, catch pins 12*b* align with notches 17*d*, and removal of foot pressure then allows biasing member to force anchor 16*b* upwardly into its extended position as shown in FIG. 15. Other types of catches can be used, such as those that would catch when one pushes down on anchor 16*b*, but then release when anchor 16*b* is pressed down again. The receiver is engageable with said anchor when said anchor is projecting up from and partially out of said housing as shown in FIG. 15.

The anchor device 16 is preferably dust and dirt tight when closed to prevent dust and dirt from entering the housing 17 and disrupting sliding of the restraining post 12.

The embodiments shown in the Figures and described use a single anchor 16 device with a single restraining post 12. Multiple anchor devices 16 or an anchor device 16 having more than one restraining post 12 can be used. It is preferred that when using a single anchor device 16 and restraining post 12 the connector 13 have the slots 20 located near the center to provide a more stable walker which will not twist to one side when pulled on by a user. Preferably the anchor device 16 includes multiple aligned spaced apart restraining posts 12 that engage with multiple slots 20 to improve the stability of the walker or cane when engaged with the anchor device 16. Anchor devices 16 can be placed at various locations in a home that suit the user. Next to a bed, in a bathroom across from the toilet, in front of a favorite chair, at a dining room table and the like.

In another embodiment the anchor device 16 comprises a tie down device where the tie down ring is activated to a raised position by a magnetized connector 13. In this embodiment the connector 13 will be provided with hooks instead of slots to engage with the tie down when in a raised position.

In another embodiment shown in FIGS. 10-13 the connector 13 comprises a switchable permanent magnet 25 that can be adjusted to varying magnetic field strengths. The strength of the magnetic field when active preferably should have a substantial breakaway force which allows a user to pull himself or herself up out of a seat, or lower down into a seat, without the magnetic connection to the floor anchor breaking away. Switchable permanent magnets are available with breakaway forces of at from several hundred to about a thousand pounds.

In this embodiment the anchor device 16 can comprise a magnet or ferromagnetic material such as a steel or iron plate attached flush with the floor. As shown in FIGS. 10-13 the switchable permanent magnet connector 25 comprises a ferro magnetic horseshoe 26/rotatable permanent magnet 27 combination mounted on a spring loaded support 28 and fixed to the walker or cane with a support bracket 30. The spring 29 is stretched when the connector 25 is engaged with the anchor 33 and returns the switchable permanent magnet connector 25 to an upper position when the permanent magnetic connector 25 is disengaged from the anchor device 33. The permanent magnet connector 25 includes a manual switch 31 employed by the user of the walker to rotate the rotatable permanent 27 within the horseshoe magnet 26 through a manual switch activator cable 32 running between the handle 34 of the walker and the manual switch 31 of the switchable permanent connector 25. Other switchable permanent magnets can be used. Switchable permanent magnets work on the principle that when two magnets are placed in close proximity the flux output can be increased by simple alignment of the north and south poles of each magnet with each other. En the embodiment shown the horseshoe shaped magnet 26 and a second rotatable magnet 27 are aligned with each other in the connector 25. When the rotatable magnet 27 is rotated relative to the horseshoe magnet 26 to align the north and south poles of the two magnets flux output is increased sufficiently to securely engage with the anchor 33.

The connectors can be attached to a walker or cane using clamps and the like. Similarly, a connector could be attached to a hand held assist bar, and could be used to assist a person rise by engaging a wall mounted anchor device 16.

FIG. 14 shows connector 43, which is an alternative embodiment of the connector 13, coupled by a coupler 50 to the bottom cross bar of a walker, positioned above but not yet engaging the anchor head 15 of extendible anchor 16*a*, shown projecting up from within an alternative embodiment housing 17*a*. Coupler 50 comprises clamping members 51 and 55, preferably made of a slightly flexible material such as aluminum, nylon or similar polymeric material. Clamping member 51 comprises a central body portion 52 with a clamping half 51*a* located at one end thereof. The other clamping half 51*b* can be secured to clamping half 51*a* by suitable fasteners, such as nut and bolt combinations, with the lower cross bar of a walker, or the leg of a cane or an assist bar, clamped between the clamping halves 51*a* and 51*b*. A tab 53 projects from the other end of body 52 for connecting to clamping member 55.

Clamping member 55 comprises a split ring clamp 56 joined to a "U" shaped clamp 57. Split ring clamp 56 includes clamping arms 56*a* and 56*b*, which extend in a curvilinear manner so that they can be clamped together around the leg 44 or connector 43. Because clamping member 55 is made of a slightly flexible material, one can slide the leg 44 of a connector 43 between the clamping arms 56*a* and 56*b*, and then tighten them against one another at their ends by suitable fasteners, such as a nut and bolt combination. This clamps the leg 44 of connector 43 tightly within clamping member 55 of coupler 50. The "U" shaped clamping portion 57 has spaced arms 57*a* and 57*b*, for embracing the tab end 53 of clamping member 51. A nut and bolt type fastener can be used to clamp arms 57*a* and 57*b* tightly against tab 53. Shown specifically is a wing head bolt 58 for easy manipulation. Tab 53 is rounded so that clamping members 51 and 55 can be secured together at different angles, providing flexibility for connecting to different types of mobility assists, e.g. walkers, canes or personal assist bars as discussed above.

Alternative embodiment connector 43 is preferable made of aluminum, and comprises a leg 44 and an anchor receiver 45 on the end of leg 44. Receiver 45 comprises a magnet housing 46 in which a permanent magnet is located, and spaced slotted cavities 47, located underneath the magnet housing 46. As the receiver 45 approaches an anchor device 16, it lifts the ferromagnetic anchor 16*a* up out of housing 17*a*, allowing the user to slide one of the slotted cavities of said anchor receiver 45 over the anchor head 15, and embracing restraining post 12 within the slot of slotted cavity 47.

Alternative embodiment housing 17*a* is a longer housing so as to entirely close anchor 16*a* when it is retracted. It also includes an associated floor plate 17*b*.

The preferred embodiments provide a mobility device and system that permits an infirm person to use a walker, cane or the like to assist in lowering or raising him or herself to or from a sitting position with minimal assistance from a second person. The foregoing are preferred embodiments of the invention, and various changes and alterations can be made without departing from the spirit of the invention.

The invention claimed is:

1. An apparatus for assisting a person to rise from or recline to a sitting position using a mobility assistance device, comprising:

a connector for securing to a mobility assist device, said connector including a magnet and a receiver;

an anchor device for mounting in a support surface, wherein said connector is detachably engageable with said anchor device, said anchor device comprising a retaining post using ferromagnetic material where said receiver is engageable with said retaining post when said retaining post is drawn up from and partially out of said anchor device by said magnet;

a coupler for coupling said connector to the mobility device, where the coupler comprises a first clamp for clamping to said connector, and a second clamp for connection to said mobility device; said first clamp and second clamp being pivotally joined to each other such that the angle of said first clamp and second clamp can be adjusted relative to one another; and whereby when said connector is engaged with said anchor device, the mobility assistance device provides support for a person to pull on, in the opposite direction, for helping the person sit or stand without the mobile assistance device becoming unstable.

2. The apparatus of claim 1, wherein said receiver comprises at least one slotted cavity, located underneath said magnet, whereby as said anchor device approaches said receiver, it lifts post up and partially extending out of said anchor device, allowing a user to slide a slotted cavity of said receiver over a head of said post, embracing said post within said slot of said slotted cavity.

3. The apparatus of claim 1, wherein said connector further comprises a leg extending from said magnet housing of said receiver, one of said clamps of said connector being adjustably connectable to said leg.

4. The apparatus of claim 1, wherein said anchor comprises a plate of ferromagnetic material, wherein the strength of the magnetic field when said magnet is active creates a substantial breakaway force threshold which allows a user to pull himself or herself up out of a seat, or lower down into a seat, without the magnetic connection to the floor anchor breaking away.

5. The apparatus of claim 4, wherein said magnet is mounted on a biased support which can be coupled to a mobile assist device; said biased support including a biasing member which is connected to said magnet, and biases said magnet to a position elevated above said anchor in use; said biasing member allowing said magnet to extend down and engage said anchor when said-magnet is attracted to said anchor, but returns said magnet to said elevated position when said magnet is no longer attracted.

6. The apparatus of claim 1, wherein said anchor device comprises an anchor slideably mounted in a housing; said anchor including an anchor head; said connector including a receiver which is engageable with said anchor head when said anchor is projecting up from and partially out of said housing; said anchor being biased to project partially out of said housing, but being retained by a catch to hold said anchor down within said housing; said catch being engaged or released by the pushing and/or twisting of said head of said anchor.

* * * * *